US006057656A

United States Patent [19]

Ohashi et al.

[11] Patent Number: 6,057,656

[45] Date of Patent: May 2, 2000

[54] MAGNET BLOCK ASSEMBLY FOR INSERTION DEVICE

[75] Inventors: Ken Ohashi, Fukui-ken; Masayuki Kawai, Ibaraki-ken, both of Japan

[73] Assignees: Shin-Etsu Chemical Ci., Ltd., Tokyo; Kawasaki Jukogyo Kabushiki Kaisha, Hyogo-ken, both of Japan

[21] Appl. No.: 09/059,086

[22] Filed: Apr. 13, 1998

[30] Foreign Application Priority Data

Apr. 14, 1997 [JP] Japan ..... 9-095542

[51] Int. Cl.[7] ..... H01F 7/00; H01F 7/02; H01J 23/10

[52] U.S. Cl. ..... 315/503; 315/507; 315/500; 335/306; 335/304; 335/210; 335/212

[58] Field of Search ..... 315/503, 507, 315/500; 335/306, 304, 210, 212

[56] References Cited

U.S. PATENT DOCUMENTS 5,596,304 1/1997 Tatchyn ..... 335/306
5,714,850 2/1998 Kitamura et al. ..... 315/507

FOREIGN PATENT DOCUMENTS 8-213199 8/1996 Japan .

*Primary Examiner*—Edward P. Westin
*Assistant Examiner*—Nikita Wells
*Attorney, Agent, or Firm*—McAulay Nissen Goldberg Kiel & Hand, LLP

[57] ABSTRACT

Disclosed is a novel composite magnet assembly for an insertion device of the Halbach type or hybrid type to be inserted into the linear part of, for example, an electron accelerator to generate a sine-curved periodical magnetic field in the air gap between two oppositely facing composite magnet block arrays. Different from a conventional magnet block assembly consisting of a plurality of permanent magnet blocks or alternate assembly of permanent magnet blocks and soft-magnetic pole pieces, the inventive magnet block assembly is composed of a plurality of oppositely facing composite magnet blocks each formed with a single base magnet block provided with a plurality of slits into which insert magnet pieces or insert pole pieces are inserted so that the dimensional accuracy in the length-wise direction of the magnet block assembly can be greatly decreased to improve the regularity of the periodical magnetic field. The base magnet block as well as the insert magnet piece in the Halbach type assembly can be magnetized after assemblage by the application of a pulsed magnetic field.

6 Claims, 5 Drawing Sheets

MAGNET BLOCK ASSEMBLY FOR INSERTION DEVICE

BACKGROUND OF THE INVENTION

The present invention relates to a novel magnet block assembly for an insertion device which is inserted into the linear part of an electron accelerator or electronic storage ring to emit a synchrotron radiation of high intensity. More particularly, the invention relates to an assembly of permanent magnet blocks for a compact-size insertion device of a small period length having a large number of periods despite the compactness as well as to a method for the magnetization of the magnet blocks in the assembly.

As is known, an insertion device is a device inserted into the linear part of an electron accelerator or electronic storage ring to emit a synchrotron radiation of high intensity. An insertion device of the prior art is a device, as is illustrated in FIG. 3A by a perspective view, having a structure of a magnet block assembly consisting of at least two arrays of permanent magnet blocks disposed to oppose each the other to form an air gap therebetween. When the directions of magnetization of the individual permanent magnet blocks are as shown in FIG. 3A indicated by the small arrows on the end surfaces of the respective magnet blocks, as is illustrated in FIG. 3B, a periodical magnetic field is generated in the air gap between the opposite arrays of the magnet blocks as indicated by the sine curve within the plane defined by the axes Z and Y in FIG. 3A. The insertion device to generate such a periodical magnetic field are classified into two types including, one, those of the Halbach type composed of permanent magnet blocks 20, 30, 40, 50, . . . only as is schematically illustrated in FIG. 4A by a side view and, the other, those of the hybrid type of which each array is composed of alternately arranged permanent magnet blocks 30, . . . and blocks of a soft magnetic material or pole pieces 32,.

When high-speed electrons travelling in an electron accelerator enter the periodical magnetic field between the arrays of magnet blocks along the direction Z in FIG. 3A, the electron takes a meandering motion within the plane defined by the axes Z and X as is illustrated in FIG. 3C to emit a synchrotron radiation at each of the meandering points as is reported by Halbach in Nuclear Instruments and Methods, volume 187, page 109 (1981). The mode for the emission of the synchrotron radiation is called either a wiggler mode or undulator mode depending on the extent of meandering of the electrons. In the wiggler mode emission, the radiations emitted at the respective meandering points are superimposed to give a white synchrotron radiation having an overall intensity 10 to 1000 times higher than the radiation from a bending electromagnet. In the undulator mode radiation, on the other hand, the radiations emitted from the respective meandering points interfere each with the others to give a radiation intensity 10 to 1000 times still higher than the wiggler mode radiations relative to the fundamental radiation and higher harmonics thereof. The differentiation between the wiggler mode radiations and undulator mode radiations can be made in terms of the value of a parameter $K=0.934\ \lambda m\ (m)\cdot Bg\ (Tesla)$, where $\lambda m$ is the length of a period and Bg is the peak value of the periodical magnetic field. Namely, an undulator mode is obtained when the value of K is about 1 or smaller while the radiation is of the wiggler mode when K is otherwise. For simplicity and convenience, the terms of undulator and insertion device are used in the present invention to cover both of these two modes. Further, in the following description, the "air gap direction" means the direction from a magnet block in a first magnet block array to a magnet block in a second magnet block array to oppose the magnet block in the first array or, namely, the direction of the axis Y in FIG. 3A. The "axial direction" in the following description means the direction of the orbit of electrons entering and traveling through the periodical magnetic field between the magnet block arrays or, namely, the direction of the axis Z in FIG. 3A.

While, as is mentioned above, insertion devices are grossly classified into those of the Halbach type and those of the hybrid type, no great differences are found therebetween relative to the value and distribution of the magnetic field. Generally speaking, however, the overall weight of the magnet blocks can be smaller in the hybrid type ones than in the Halbach type ones. In addition, the hybrid type insertion devices were preferred in the early stage of development when the manufacturing technology was at a low level not to give magnet blocks with high accuracy relative to the value and angle of magnetization in the magnet blocks while the requirements for the accuracy of the above were lower in the hybrid type than in the Halbach type. In recent years, however, a satisfactory magnetic field distribution can be obtained in each of the insertion devices of the Halbach type and hybrid type as a result of the improvement in the magnet manufacturing technology and introduction of the method for recombination of magnet block pairs. The displacement of the electron orbit caused by the change in the air gap spacing is smaller in the Halbach type than in the hybrid type due to the linearity held therein as compared with the hybrid type with non-linearity of the soft-magnetic pole pieces 32 to cause a relatively large displacement of the electron orbit. The magnet block arrays illustrated in FIGS. 4A and 4B are each conventional and called a planar undulator. Accordingly, choice of either one of these types is not a matter of superiority or inferiority but entirely depends on the particularly intended application of the insertion device.

The most conventional method for fixing and assembling permanent magnet blocks into an array is illustrated in FIG. 5 by a cross sectional view within the plane X-Y in FIG. 3A. Thus, the magnet block 20 is set in a rigid cassette 21 of a non-magnetic material and fixed at the position either by using an adhesive or by a mechanical means with presser plates 23 and screw bolts 24. The adhesive means and mechanical means can be used in combination. Basically, the mechanical means has higher reliability than adhesive bonding. The magnetic field generated by the magnet block can be adjusted by means of the adjustment hole 22 formed on the bottom or on the side wall of the cassette 21. Since the cassette 21 can be prepared by mechanical working using precision machine tools, the dimensional accuracy of the cassette 21 is generally high as compared with the magnet block 20. While the positioning accuracy of the magnet blocks 20 in the length-wise direction of the magnet block array is particularly important, the positioning accuracy of the magnet blocks as required can be obtained when the accuracy in the dimension of the cassette 21 and the screwing females for the screw bolts 23 is ensured. In view of these advantages, the permanent magnet blocks 20 in the insertion devices are usually fixed and assembled by using a cassette 21 in most cases.

The above mentioned advantages obtained by using a cassette for assembling a number of magnet blocks, however, are no longer held when the period length (see FIG. 3A) of the insertion device is small with a consequently small thickness of each of the magnet blocks. Suppose an insertion device of the Halbach type having a period length of 10 mm, in which a single period is formed from four magnet blocks, the thickness of each of the magnet blocks is only 2.5 mm. Since the orbit form of the accelerated electrons in an insertion device is greatly disturbed by the non-uniformity in the magnetic characteristics of the individual permanent magnet blocks, it is essential to minimize the errors in the remnant magnetization and angle error of magnetization When the thickness of the individual magnet blocks is very small, nevertheless, the error in the magnetic characteristics is unavoidably increased due to superimposition of several factors including (1) an increased error in the dimensions of the magnet blocks relative to the thickness, (2) a relative increase in the volume proportion of the work-degradation layers caused by the mechanical working of the magnet blocks, and (3) an increase in the error of the relative thickness of the anti-corrosion surface layer. These errors are superimposed onto the usual error in the magnetic properties as a consequence of the powder metallurgical method for the preparation of the permanent magnet blocks.

Other problems are caused also in respect of the accuracy of assembling of the magnet blocks. Since it is a usual design of insertion devices that the air gap spacing between the oppositely facing magnet blocks in two arrays is selected to be about one half of the period length, an insertion device of a period length of 10 mm is used with an air gap spacing of about 5 mm. While the dimensional error in a permanent magnet block prepared by mechanical working usually cannot be much smaller than ±0.05 mm, an error of ±12% is expected as a possible maximum in the magnetic field in the air gap direction and an integrated error of ±4% is expected as a possible maximum in the magnetic field in the axial direction. Accordingly, it is a requisite in an insertion device having a period length of 10 mm that the error in the dimensional accuracy of the permanent magnet blocks used therein must not exceed one half or one third of that in an insertion device having a conventional period length of 30 mm or larger.

The above mentioned high accuracy requirement in the dimensions of the individual permanent magnet blocks is of course of little significance unless being accompanied by the accuracy in assembling of the magnet blocks into an array, which can be obtained only with a difficulty. Assuming that the magnet blocks 20 of each 2.5 mm thickness are assembled each by using a non-magnetic cassette 21, as is illustrated in FIG. 5, to form a Halbach type insertion device of 10 mm period length, for example, the width of the presser plate 23 must be very small and the size of the screw bolts 24 must be correspondingly so small because the thickness of the cassette 21 is also 2.5 mm to hold a single magnet block 20. The screw bolt 24 thrusted into the female in the cassette of 2.5 mm thickness cannot be larger than the screw bolt of the Ml size in consideration of the difficulty in tapping of the female thread and the size of the bolt head. Since the magnetic attractive force between the oppositely facing two permanent magnet blocks in the two arrays is so strong that no very reliable assemblage of the magnet blocks can be ensured with so feeble holding means with tiny screw bolts 24. Although it is a seemingly possible way that the permanent magnet blocks are directly fixed to a single base plate instead of using separate cassettes, this way is not always practical because gap spaces are sometimes formed between adjacent magnet blocks due to the repulsive and rotational forces therebetween resulting in inaccuracy in the positioning of the magnet blocks in the length-wise direction of the magnet block array and consequently in an increased error in the magnetic field distribution within the air gap between the magnet block arrays.

In view of the above described problems and disadvantages in the prior art in the preparation of a permanent magnet block assembly for an insertion device having a period length not exceeding 10 mm, it is eagerly desired to develop a novel method for assemblage of thin permanent magnet blocks apart from a mere improvement or extension of the prior art methods.

One of the inventors, together with a co-inventor, previously proposed, in Japanese Patent Kokai 8-255726, a magnet block assembly for a short-period insertion device in which, as is schematically illustrated in FIG. 6, a plurality of magnet blocks are assembled in an array and magnetized with high precision in alternately reversed directions perpendicular to the length-wise direction of the array. The magnet block arrays there proposed serve to realize an insertion device of a period length not exceeding 20 mm. The characteristic advantages obtained with this magnet block assembly include a decrease in the requirement for the dimensional accuracy of the individual magnet blocks because a single permanent magnet block here covers a period or more in a conventional Halbach type insertion device composed of four or more magnet blocks, a decreased problem due to the working-degraded surface layer of the magnet blocks, applicability of the conventional assembling method with non-magnetic cassettes and a decrease in the assembling accuracy of the magnet blocks as a consequence of the decrease in the number of the magnet blocks. This method, however, has different difficulties relating to the accuracy in the distribution of the magnetic field for the magnetization of the magnet blocks and precision control of the positions of magnetization.

When magnetization of the magnet blocks is conducted consecutively with pulses of magnetic field by using a magnetization head having a coil, it is unavoidable that the electric resistance of the coil is gradually increased as the temperature thereof is increased as a result of heat generation therein to cause a shift in the distribution of the pulsed magnetic field. Since the magnetization behavior of a rare earth-based permanent magnet is non-linear relative to the magnetic field for magnetization, the magnetization pattern of the permanent magnet blocks is accordingly subject to a change thereby. This phenomenon is particularly remarkable at the boundary of the N-pole and the S-pole such as the boundary regions between the magnet block 20 and the adjacent blocks 40. As a consequence, a disturbance is caused in the distribution of magnetic field around the undulator formed by assembling the permanent magnet blocks resulting in irregularity of the electron orbit in the insertion device.

It is important in the magnetization of the magnet blocks of an undulator to exactly control the positions of magnetization. Any irregularity in the magnetization positions of the magnet blocks results in an irregular distribution of the thickness of the individual magnet units. It is necessary accordingly that positioning of the magnetization head or relative positioning of the magnetization head and the permanent magnet blocks has an accuracy with an error of ±0.05 mm or, desirably, ±0.02 mm or smaller. This very strict requirement can be satisfied only by the use of a precision-controlled driving system for the magnetization head.

SUMMARY OF THE INVENTION

The present invention accordingly has an object to provide a novel assembly of permanent magnet blocks for an insertion device of a small period length not exceeding, for example, 10 mm, with which the above described difficulties and disadvantages in the prior art can be overcome by a simple and convenient means.

Thus, the magnet block assembly for an insertion device provided by the present invention is an assembly which comprises:

(A) at least two oppositely facing composite magnet blocks each consisting of a base block of a permanent magnet provided with a plurality of slits each running across the base block between two cantilever sectional parts in the base block at regular intervals, the cantilever sectional parts each being magnetized in an alternately reversed direction perpendicular to or in parallel to the length-wise direction of the base block; and (B) a plurality of insert magnet pieces or insert pole pieces of a soft magnetic material each inserted into one of the slits in the base blocks, the direction of magnetization of the insert magnet pieces being perpendicular to that of the cantilever sectional parts of the base block.

DETAILED DESCRIPTION OF THE PREFERRED EMBODIMENTS

Although the principle of the above defined magnet block assemblies of the invention for an insertion device is applicable to insertion devices of any size, the invention is particularly useful and advantageous when applied to an insertion device having a period length not exceeding, for example, 10 mm.

Following is a detailed description, by making reference to the accompanying drawing, of the magnet block assemblies of an insertion device according to the invention.

Figure 1A:
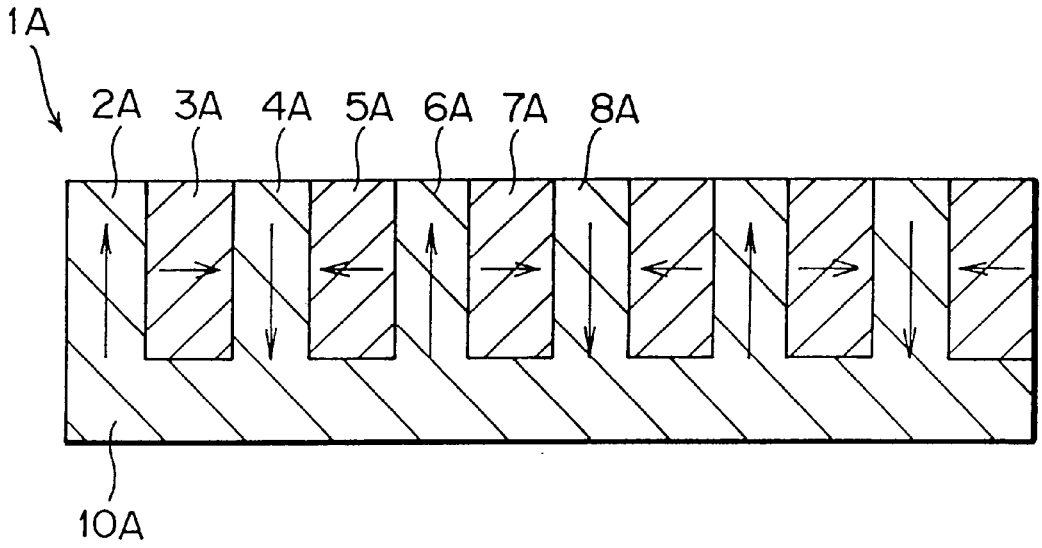
FIGS. 1A and 1B are each a schematic length-wise cross sectional view of an elongated composite magnet block for an insertion device of the Halbach type and hybrid type, respectively, according to the invention.
Figure 1B:
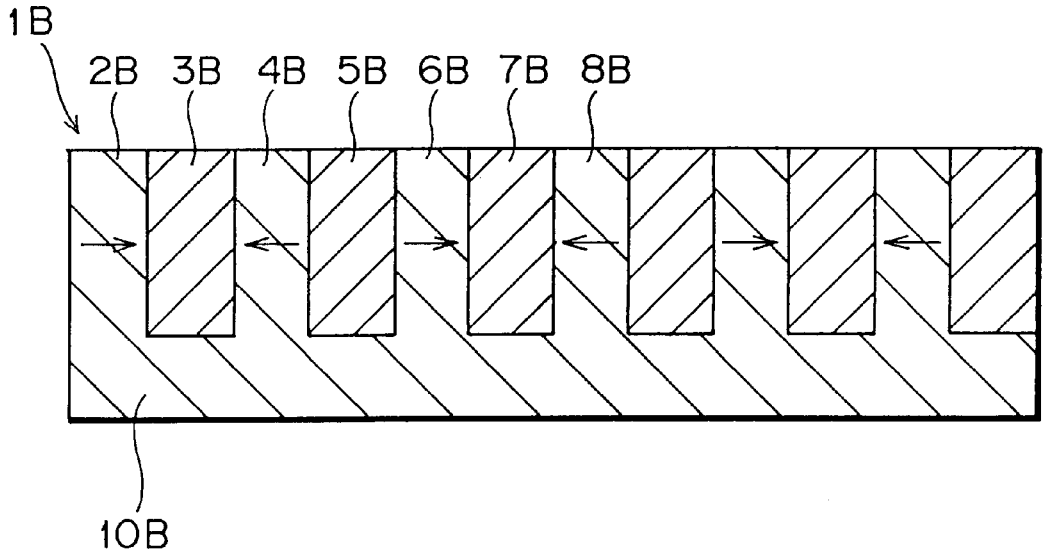

FIGS. 1A and 1B each schematically illustrate a length-wise cross sectional view of a composite magnet block of the planar undulator 1A and 1B of an insertion device of the Halbach type and hybrid type, respectively.

Needless to say, the base block of a permanent magnet 10A or 10B as a base of the composite magnet block 1A,1B must have a sufficient length corresponding to at least one period of the insertion device. When the base magnet block 10A is anisotropically magnetic, the axis of easy magnetization thereof should be in the air gap direction or, namely, in the direction perpendicular to the travelling direction of electrons, i.e. the axial direction, in the air gap as indicated by the arrows written in the base magnet block 1A.

The magnet block 10A is prepared by mechanical working on a magnet block by using a suitable machine tool with a grinding stone. Namely, a magnet block is mechanically worked to form a plurality of slits across the block, into which insert magnet pieces 3A, 5A, 7A, . . . are to be inserted each between two adjacent cantilevered sectional parts 2A, 4A, 6A, 8A, . . . , at regular intervals to define the period length of the undulator. Each of the slits formed across the base magnet block 10A has a thickness just to fit the insert magnet piece 3A, 5A, 7A, . . . to be inserted thereinto without any play and fixed thereto, for example, by using an adhesive to complete the composite magnet block 1A.

The base magnet block 10A with a plurality of slits is magnetized in the cantilever sectional parts 2A, 4A, 6A, 8A, . . . in the alternately reversed air gap direction as shown by the arrows written in the respective parts while the insert magnet pieces 3A, 5A, 7A, . . . are magnetized in the alternately reversed axial direction also shown by the arrows written therein. The base magnet block 10A and the insert magnet pieces 3A, 5A, 7A, . . . can be magnetized separately in advance of the assemblage thereof into a composite magnet block 1A. It is an alternative possible way that these members before magnetization are assembled into the form of the composite magnet block 1A and the members are magnetized at one time by means of a pulsed magnetic field for magnetization. In this case, the two opposite cantilever sectional parts on the opposite composite magnet blocks 1A, 1A are magnetized in the same air gap direction while each of the insert magnet pieces in one of the composite magnet block is magnetized in the axial direction reverse to that of the insert magnet piece oppositely facing the piece in the other composite magnet block.

It is of course an alternatively possible way relative to the direction of magnetization of the respective magnet blocks in the composite magnet block for an insertion device of the Halbach type that, though less preferable, the cantilever sectional parts 2A, 4A, 6A, 8A, . . . are magnetized each in the alternately reversed axial direction and the insert magnet pieces 3A, 5A, 7A, . . . are magnetized each in the alternately reversed air gap direction. Following is the reason for the less preference of this way of magnetization. When the directions of magnetization of the magnet members are as shown in FIG. 1A, the repulsive force, which each of the insert magnet pieces 3A 5A, 7A, . . . magnetized in the axial direction receives from the cantilever section-al parts 2A, 4A, 6A, 8A, . . . magnetized in the air gap direction, is in such a direction that the insert magnet piece is pushed against the bottom of the respective slit so that positioning of the insert magnet pieces can be accomplished spontaneously even without using any adhesives.

FIG. 1B is a schematic length-wise cross sectional view of a composite magnet block 1B for an insertion device of the hybrid type. The base magnet block 10B here is conformal to the base magnet block 10A illustrated in FIG. 1A for the Halbach type with a plurality of slits across the base magnet block 10B, into each of which an insert pole piece of a soft magnetic material 3B, 5B, 7B, . . . is inserted, instead of the insert magnet pieces 3A, 5A, 7A, . . . in FIG.

1A, each between the cantilever sectional parts 2B, 4B, 6B, 8B, . . . It is preferable in this case that the cantilever sectional parts 2B, 4R, 6B, 8B, . . . are magnetized each in the alternately reversed axial direction. If the elongated magnet block 10B is anisotropically magnetic, it is therefore preferable that the axis of easy magnetization thereof is in the axial direction. In assemblage of two of such composite magnet blocks 1B, 1B, the direction of magnetization of each of the cantilever sectional parts is in the reversely axial direction relative to that of the oppositely facing cantilever sectional part in the other composite magnet block 1B.

As is understood from the above given description, the composite magnet block 1A, 1B, being composed on the base of a single base magnet block 10A, 10B instead of integration of a large number of unit magnet blocks in the prior art, with insertion of the insert magnet pieces or insert pole pieces inserted into the slits in the base magnet block, is advantageously free from the dimensional error in the axial direction due to superimposition of the thickness errors in the individual unit magnet blocks in the prior art. This advantage is of particular significance in an insertion device of which the period length is small to be, for example, 10 mm or less.

In the following, a method for the magnetization of the above described composite magnet block is described in detail by making reference to FIG. 2, in which the composite magnet block 1A is of the Halbach type shown in FIG. 1A.

Figure 2:
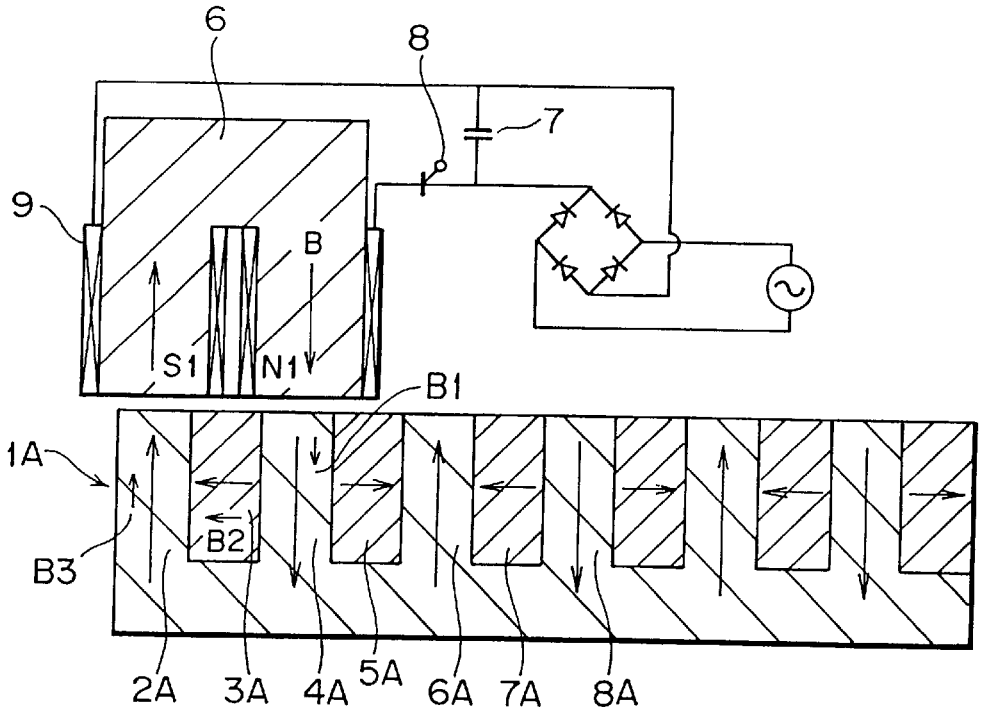
FIG. 2 is a schematic illustration of the magnetization system for the magnetization of the composite magnet block for an insertion device according to the invention.
Figure 3A:
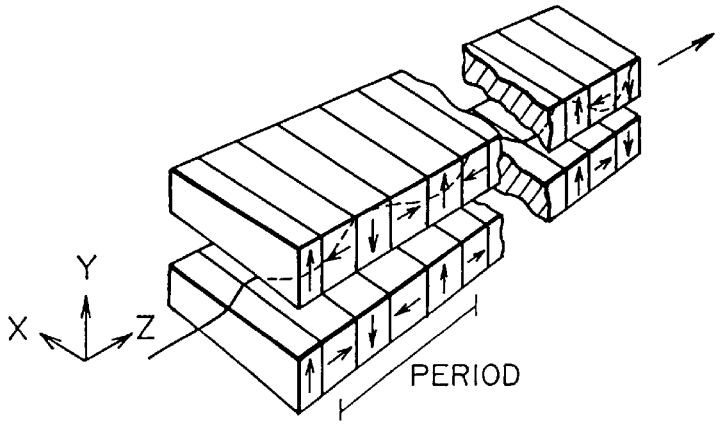
FIG. 3A PRIOR ART
FIG. 3A is a schematic perspective view of the magnet block arrays of the Halbach type for a conventional insertion device.
Figure 3B:
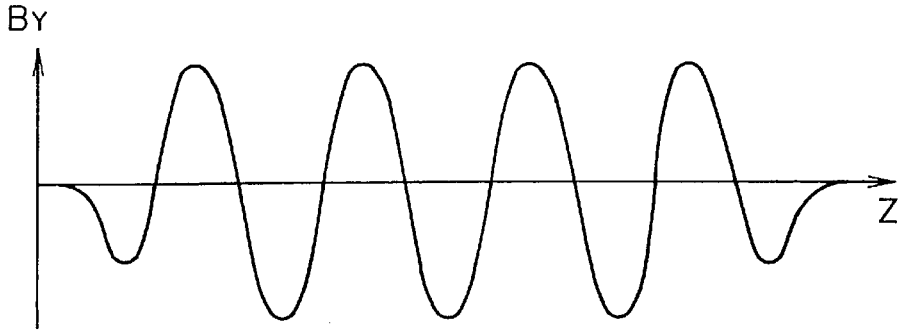
FIG. 3B PRIOR ART
FIG. 3B is a graph showing the sine-curved periodical magnetic field generated in the air gap between the magnet block arrays of FIG. 3A.
Figure 3C:
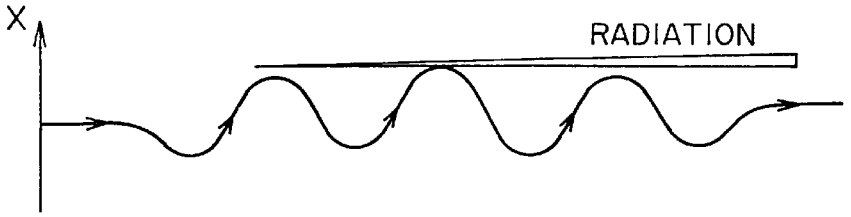
FIG. 3C PRIOR ART
FIG. 3C is an illustration of the meandering electron orbit travelling in the periodical magnetic field shown in FIG. 3B.
Figure 4A:
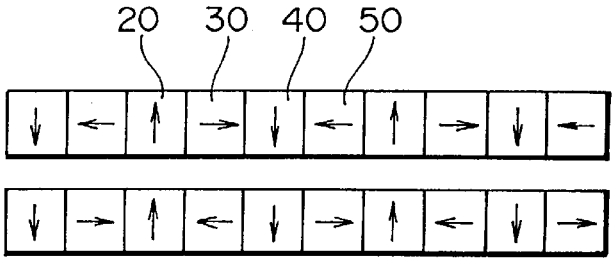
FIG. 4A PRIOR ART
FIG. 4A shows the basic arrangement of the permanent magnet block assemblies in an insertion device of the Halbach type.
Figure 4B:
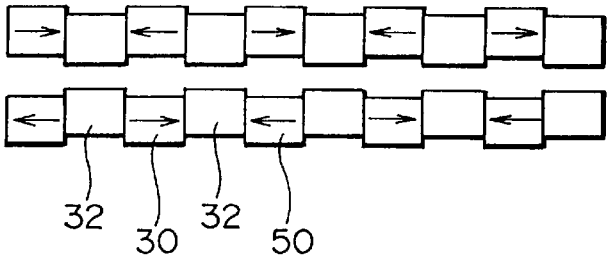
FIG. 4B PRIOR ART
FIG. 4B shows the basic arrangement of the permanent magnet blocks and soft-magnetic pole pieces in an insertion device of the hybrid type.
Figure 5:
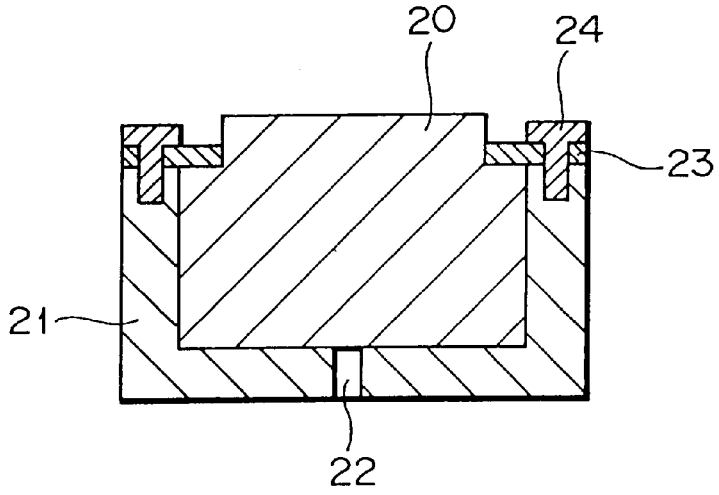
FIG. 5 PRIOR ART
FIG. 5 is a cross sectional view of a permanent magnet block held in a non-magnetic cassette to build up a planar undulator.
Figure 6:
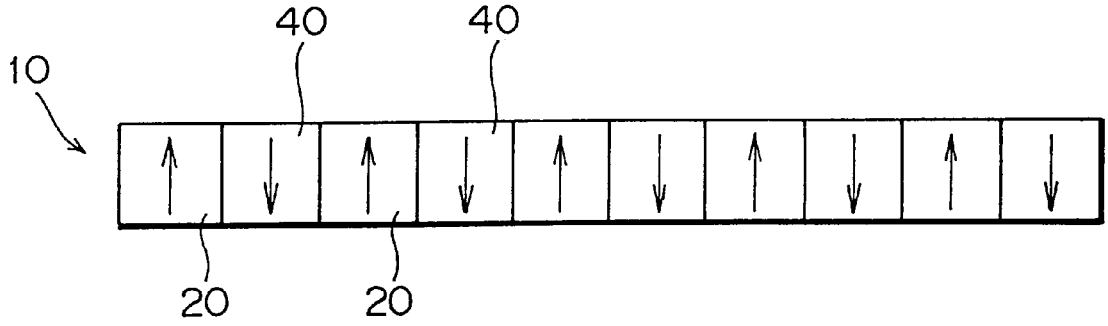
FIG. 6 PRIOR ART
FIG. 6 illustrates a magnetization pattern of permanent magnet blocks in an undulator of a small period length.

FIG. 2 is a schematic illustration of the system to generate a pulsed magnetic field for the magnetization of the composite magnet block 1A with a cross sectional view of the electromagnet 6 as the magnetization head.

With the magnetization head 6 mounted on the composite magnet block 1A as is shown in FIG. 2, the electric charge accumulated in the capacitor bank 7 is instantaneously discharged by means of the thyristor switch 8 to cause a very large electric current through the coil 9 of the electromagnet 6 so that a pulse-wise large magnetic field indicated by the arrow B is generated to form a closed magnetic circuit along the route from the N1 pole to the SI pole of the electromagnet 6 through the cantilever sectional part 4A, insert magnet piece 3A and cantilever sectional part 2A so that they are magnetized in the direction indicated by the respective arrows. Since the distance between the cantilever sectional parts 2A, 4A is invariable as determined by the machining accuracy for the formation of the slit to which the insert magnet piece 3A is inserted, the accuracy in the positioning of the poles of the magnetization head is not under a strict requirement. The magnetic field for the magnetization in this case should be at least 15 kOe or, preferably, at least 18 kOe in order to accomplish magnetization with good reliability. The pulse width of the pulsed magnetic field should be at least 0.5 msecond or, preferably, at least 2 mseconds. It is of course possible to accomplish magnetization with a static magnetic field if an electromagnet and a DC power source of such a large capacity are available disregarding the large costs therefor.

Although, in the above described procedure for obtaining a composite magnet block 1A, the magnetization is conducted after assemblage of the base magnet block 10A with slits and the insert magnet pieces 3A, 5A, 7A, . . . into the composite magnet block 1A, it is of course optional that the base magnet block 10A with slits and the insert magnet pieces 3A, 5A, 7A, . . . are separately magnetized in advance and the thus magnetized members are assembled into a magnetized composite magnet block 1A. In this latter case of pre-assemblage magnetization, however, difficulties are unavoidable because, in contrast to the former case of post-assemblage magnetization, each of the insert magnet pieces 3A, 5A, 7A, . . . already magnetized must be inserted under a repulsive or attractive force into one of the slits in the base magnet block 10A magnetized in a direction perpendicular to that of the insert magnet pieces 3A, 5A, 7A, . . . .

In the post-assemblage magnetization procedure illustrated in FIG. 2, the magnetic flux for magnetization forms a closed circuit from the N1 pole of the magnetization head 6 to the S1 pole thereof through the cantilever sectional part 4A, insert magnet piece 3A and cantilever sectional part 2A as indicated by the arrows B1, B2 and B3, respectively, so that the cantilever sectional parts 2A, 4A and the insert magnet piece 3A can be magnetized at one time to give a magnetized composite magnet block 1A in which the insert magnet pieces 3A, 5A, 7A, . . . can be spontaneously positioned by means of the repulsive or attractive force with the cantilever sectional parts 2A, 4A, 6A, 8A, . . . .

The procedure for the magnetization of a hybrid type composite magnet block 1B is substantially the same as that described above for the Halbach type composite magnet block 1A.

The types of the permanent magnets forming the composite magnet blocks 1A, 1B are not particularly limitative but anisotropically magnetizable magnets prepared by a powder metallurgical process from a rare earth metal-based alloy, such as the samarium-cobalt alloys and rare earth-iron-boron alloys, are preferred in respect of the strong magnetic field generated in the air gap between the composite magnet blocks. When magnetization of the composite magnet block 1A or 1B is conducted by the post-assemblage magnetization procedure, in particular, rare earth-iron-boron alloys are more preferable due to easiness in the magnetization with a pulsed magnetic field. The magnetized composite magnet blocks are held each in a holding cassette without problems. The material to form the holding cassette is not particularly limitative provided that the material is rigid and non-magnetic including aluminum or aluminum-based alloys, stainless steels and brass, of which stainless steels are preferred in respect of their high sliding resistance. The soft magnetic material for the insert pole pieces to be inserted into the slits in the base magnet block 10B for a hybrid type composite magnet block 1B is preferably iron or an iron-based alloy such as a low-carbon steel SS400, SUY and ironcobalt alloys.

Two or more of the composite magnet blocks 1A or 1B are assembled into an undulator of a small period length for an insertion device, in which the number N of periods in a composite magnet block of 100 cm length can be as large as 100 assuming a period length of 10 mm according to the invention. Since the theoretical intensity of radiation emitted from an insertion device is proportional to the square of the number N, a very strong synchrotron radiation can be emitted even in a compact-size accelerator ring provided with an insertion device according to the invention.

In the following, a particular embodiment of the present invention is described in more detail by way of an Example.

EXAMPLE

Forty 40 mm by 40 mm wide and 20 mm thick sintered blocks of a neodymium-iron-boron magnet alloy, of which the axis of easy magnetization was in the direction of the 20 mm thickness, were each mechanically worked with a grinding stone to form slits of each having a thickness of 2 mm and depth of 15 mm at a regular interval of 2 mm in parallel to one of the side surfaces to serve as base magnet blocks.

Separately, insert magnet pieces each having dimensions of 40 mm by 15 mm by 2 mm, of which the as of easy magnetization was in the direction of the 2 mm thickness, were prepared from the same rare earth magnet alloy. These insert magnet pieces were inserted into the slits in the base magnet blocks to be fitted thereto without play to give forty composite magnet blocks.

On the other hand, a magnetization head was prepared which had magnetization teeth of a five-period span so as to enable magnetization of one of the above prepared composite magnet blocks at one time. The yoke of the electromagnet for the magnetization head was formed by laminating punch-formed 0.5 mm thick pure iron sheets and provided with a coil. The magnetization teeth of the magnetization head were brought into contact with the surface of the composite magnet block and magnetization thereof was conducted by energizing the coil with a capacitor bank of 4000 volts×5000 $\mu$F capacity to generate a pulsed magnetic field of at least 20 kOe as the peak value.

Each of the magnetized composite magnet blocks was inserted into a holding cassette made from a non-magnetic stainless steel SUS 316L and 20 a group of the cassettes were linearly assembled to form a 800 mm long elongated composite magnet block array in such a direction that each of the insert magnet pieces in all of the composite magnet blocks was within a plane across the array. A pair of the composite magnet block arrays were positioned to oppose each the other in such a way that each of the insert magnet pieces in one of the arrays just opposed an insert magnet piece in the other array with an air gap of 4 mm.

Distribution of the periodical magnetic field in the air gap of the thus prepared 800 mm-long undulator of 100 periods was measured by using a small-area Hall sensor to fmd that the peak values of the peaks in the periodical magnetic field were very uniform with a variation of ±1.5% without undertaking any adjusting means.

What is claimed is:

1. A magnet block assembly for an insertion device which comprises:

(A) at least two oppositely facing composite magnet blocks with an air gap therebetween each consisting of a base block of a permanent magnet provided with a plurality of slits each running across the base block between two cantilever sectional parts in the base block at regular intervals, the cantilever sectional parts being magnetized in an alternately reversed direction across the air gap or in parallel to the length-wise direction of the base block; and (B) a plurality of insert magnet pieces or insert pole pieces of a soft magnetic material each inserted into one of the slits in the base blocks, the direction of magnetization of the insert magnet pieces being perpendicular to that of the cantilever sectional parts of the base block.

2. A magnet block assembly for an insertion device of the Halbach type which comprises:

(A1) at least two oppositely facing composite magnet blocks with an air gap therebetween each consisting of a base block of a permanent magnet provided with a plurality of slits each running across the base block between two cantilever sectional parts in the base block at regular intervals, the cantilever sectional parts being magnetized in an alternately reversed direction across the air gap; and (B1) a plurality of insert magnet pieces each inserted into one of the slits in the base blocks, the direction of magnetization of the insert magnet pieces being perpendicular to that of the cantilever sectional parts of the base block.

3. The magnet block assembly for an insertion device as claimed in claim 2 in which the base magnet block (A1) is made from an anisotropically magnetic sintered magnet block of a rare earth-based magnet alloy having an axis of easy magnetization in the direction across the air gap and each of the insert magnet pieces (B1) is made from an anisotropically magnetic sintered magnet block of a rare earth-based magnet alloy having an axis of easy magnetization in the direction parallel to the length-wise direction of the base block.

4. A magnet block assembly for an insertion device of the hybrid type which comprises:

(A2) at least two oppositely facing composite magnet blocks with an air gap therebetween each consisting of a base block of a permanent magnet provided with a plurality of slits each running across the base block between two cantilever sectional parts in the base block at regular intervals, the cantilever sectional parts being magnetized in an alternately reversed direction parallel to the length-wise direction of the base block; and (B2) a plurality of insert pole pieces of a soft magnetic material each inserted into one of the slits in the base blocks.

5. The magnet block assembly for an insertion device of the hybrid type as claimed in claim 4 in which the base magnet block (A2) is made from an anisotropically magnetic sintered magnet block of a rare earth-based magnet alloy having an axis of easy magnetization in the direction parallel to the length-wise direction of the base block.

6. A method for the preparation of a magnetized magnet block assembly for an insertion device which comprises the steps of:

(a) inserting a plurality of unmagnetized insert magnet pieces or insert pole pieces of a soft magnetic material each into one of a plurality of slits between a pair of cantilever sectional parts of an unmagnetized base block of a permanent magnet to form a composite magnet block; and (b) applying a pulsed magnetic field sufficient to magnetize the base magnet block or the base magnet block and the insert magnet pieces, the magnetic field forming a closed magnetic circuit passing through one of the cantilever sectional parts, the insert magnet piece or insert pole piece and the other of the cantilever sectional parts.

* * * * *